United States Patent [19]

Shima et al.

[11] Patent Number: 4,880,401

[45] Date of Patent: Nov. 14, 1989

[54] ELECTRIC FEMALE CONNECTOR PIECE

[75] Inventors: Koichi Shima, Takatsuki; Motoyuki Tomizu, Yokobayashi, both of Japan

[73] Assignee: Omron Tateisi Electronics Company, Kyoto, Japan

[21] Appl. No.: 250,264

[22] Filed: Sep. 27, 1988

[30] Foreign Application Priority Data

Oct. 13, 1987 [JP] Japan ..... 62-156592[U]

[51] Int. Cl.[4] ..... H01R 13/187

[52] U.S. Cl. ..... 439/746; 439/843; 439/852

[58] Field of Search ..... 439/744, 745, 746, 842, 439/843, 847, 851, 852, 853, 854, 855, 856, 857

[56] References Cited

U.S. PATENT DOCUMENTS

| | | | |
|---|---|---|---|
| 2,775,746 | 12/1956 | Young | 439/843 |
| 3,796,987 | 3/1974 | Kinkaid et al. | 439/847 X |
| 4,342,498 | 8/1982 | Patton et al. | 439/843 X |
| 4,593,963 | 6/1986 | Endo et al. | 439/852 X |

FOREIGN PATENT DOCUMENTS

| | | | |
|---|---|---|---|
| 1061181 | 3/1967 | United Kingdom | 439/744 |

*Primary Examiner*—Z. R. Bilinsky

*Attorney, Agent, or Firm*—Foley & Lardner, Schwartz, Jeffery, Schwaab, Mack, Blumenthal & Evans

[57] ABSTRACT

An electric female connector piece for receiving a pin-shaped male connector piece therein for achieving an electric connection therewith, comprising: a connector piece main body having a C-shaped cross section by being provided with a pair of mutually opposing, elongated strips which are joined together at their long sides by a connecting strip; a contact piece consisting of an elongated strip which is adapted to be disposed between the mutually opposing strips defining a cavity of a substantially rectangular cross section; a fitting hole provided in a middle part of each of the mutually opposing strips for receiving a fitting projection provided in each lateral long edge of the contact piece; engagement portions provided at either lengthwise end of each of the mutually opposing strips for mutual engagement with corresponding projections of the contact piece; and a spring piece bent from the connecting strip for elastically urging the male connector piece against the contact piece. This connector piece saves manufacturing cost by permitting only an essential part thereof to be gold plated and simplifying the assembly process. Further, in the case of a multiple connector which incorporate a plurality of such connector pieces, by getting the fitting projections fit loosely into the corresponding fitting holes, the dimensional tolerance of the spacing between the pin-shaped male connector pieces can be favorably increased.

4 Claims, 4 Drawing Sheets

ELECTRIC FEMALE CONNECTOR PIECE

TECHNICAL FIELD

The present invention relates to an improved electric connector piece for a female connector which is adapted to receive a pin-shaped male connector piece to achieve an electric connection therewith.

BACKGROUND OF THE INVENTION

In conventional female connectors, the electric connector pieces are typically each formed into an elongated box. For example, as shown in FIG. 6, an electroconductive plate is bent into an electric connector piece 101 shaped as an elongated box provided with a lead terminal piece 101 at one of its longitudinal ends, and a pair of projecting tabs 103 and 104 formed in the mutually opposing strips 101*a* and 101*b* of the connector piece 101 in such a manner that one of the tabs 103 serves as a contact piece while the other tab 104 serves as a spring piece which elastically urges an electric male connector piece not shown in the drawing against the contact piece.

However, in such a conventional structure, since the contact piece 103 is integrally formed with the elongated, box-shaped electric connector piece 101, the whole electric connector piece 101 must be gold plated even though only the contact piece 103 is required to be gold plated, and the unnecessary gold plating leads to the increase in material cost.

In another conventional electric connector piece shown in FIG. 7, the connector piece 101 is constructed from a connector piece main body 105 having a C-shaped cross section, and a planar sheet spring piece 106. Securing tabs 107 provided in each upper edge of a pair of mutually opposing strips 105*a* and 105*b* of the connector piece main body 105 are crimped against the spring piece 106, and a contact tab 108 is bent from the connecting strip 105*c* of the connector piece main body 105. In this conventional structure also, since the contact tab 108 is integrally formed with the connector piece main body 105, the whole connector piece main body 105 having the C-shaped cross section must be gold plated, and the material cost tends to be high. Furthermore, crimping the securing tabs 107 against the spring piece 106 tends to reduce the manufacturing work efficiency.

BRIEF SUMMARY OF THE INVENTION

With the view of eliminating such shortcomings of the prior art, a primary object of the present invention is to provide an electric connector piece for a female connector which can reduce the manufacturing cost through the reduction of the cost for gold plating.

A second object of the present invention is to provide an electric connector piece for a female connector which offers an improved efficiency for its manufacture.

A third object of the present invention is to provide an electric connector piece for a female connector which offers a favorable tolerance to the deviation from exact alignment with the corresponding male connector piece so that the female connector may be favorably used in multiple connectors.

These and other objects of the present invention can be accomplished by providing an electric female connector piece for receiving a pin-shaped male connector piece therein for achieving an electric connection therewith, comprising: a connector piece main body having a C-shaped cross section by being provided with a pair of mutually opposing, elongated strips which are joined together at their long sides by a connecting strip; a contact piece consisting of an elongated strip which is adapted to be disposed between the mutually opposing strips defining a cavity of a substantially rectangular cross section; a fitting hole provided in a middle part of each of the mutually opposing strips for receiving a fitting projection provided in each lateral long edge of the contact piece; a first engagement portion provided in each of the mutually opposing strips at its lengthwise end for engagement with a corresponding part of the contact piece; a second engagement portion provided in each of the mutually opposing strips at its other lengthwise end for engagement with another corresponding part of the contact piece; and a spring tab bent from the the connecting strip for elastically urging the male connector piece against the contact piece.

Thus, since the connector piece main body having a C-shaped cross section and the elongated contact piece mounted thereto are made from two separate pieces, gold plating may be performed only to the contact piece and the manufacturing cost can be thereby reduced. Further, since the contact piece can be mounted to the connector piece simply by fitting and engaging them together, the work efficiency of the manufacturing process can be improved, in particular when at least one of the engagement portions comprises a step-shaped notch provided in each of the mutually opposing strips, and a lateral engagement projection provided in each lateral edge of the contact piece for defining a corresponding notch adapted to engage the step-shaped notch.

According to a certain aspect of the present invention, the contact piece is bent about a lateral line passing through the fitting projections with its convex surface facing the connecting strip, and the state of favorable contact between the contact piece and the corresponding male connector piece can be accomplished in addition to the obvious advantage of providing a converging taper suitable for receiving the male connector piece into the cavity of the female connector piece. Further, by substantially loosely fitting the fitting projections into the corresponding fitting holes the contact piece is given with a certain freedom of movement. Thereby, some tolerance is produced in the alignment between the pin-shaped male connector piece and the female connector piece. This is particularly significant when this connector piece is applied to a multiple connector. Further, this freedom of movement is advantageous also in achieving a favorable contact state with the male connector piece in cooperation with the spring tab.

BRIEF DESCRIPTION OF THE DRAWINGS

Now the present invention is described in the following in terms of a specific embodiment with reference to the appended drawings, in which.

DESCRIPTION OF THE PREFERRED EMBODIMENT

Figure 1:
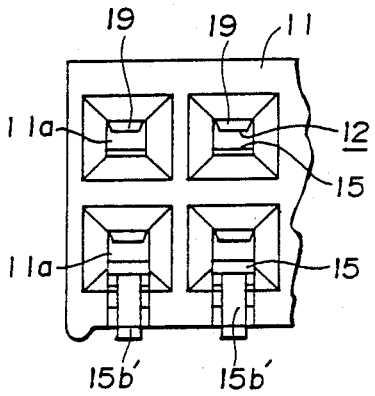
FIG. 1 is an end view of a multiple female connector to which the preferred emodiment of the present invention has been applied.
Figure 2:
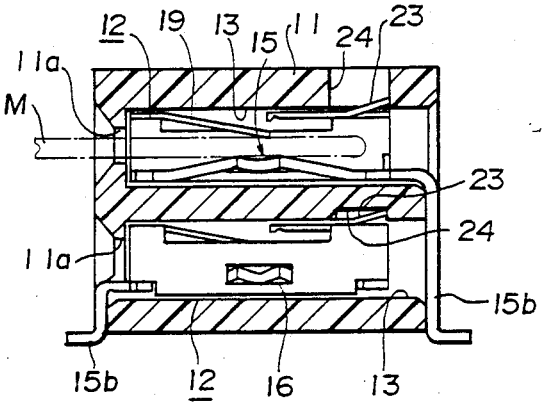
FIG. 2 is a side sectional view of the multiple female connector shown in FIG. 1, with a pin-shaped male connector piece indicated by an imaginary line.

FIGS. 1 and 2 are a front view and a side sectional view of an example of multiple connector which incorporates the electric connector pieces for a female connector according to the present invention.

This multiple female connector comprises a connector casing 11 made of an electrically insulating synthetic resin material which is provided with a plurality of insertion openings 11*a* each for inserting a pin-shaped electric connector piece M of a male connector therefrom, in two rows one above the other. Each of the insertion openings 11*a* communicates, in mutual alignment, with a receiving hole 13 for receiving the electric connector piece 12 for this female connector according to the present invention.

Figure 3:
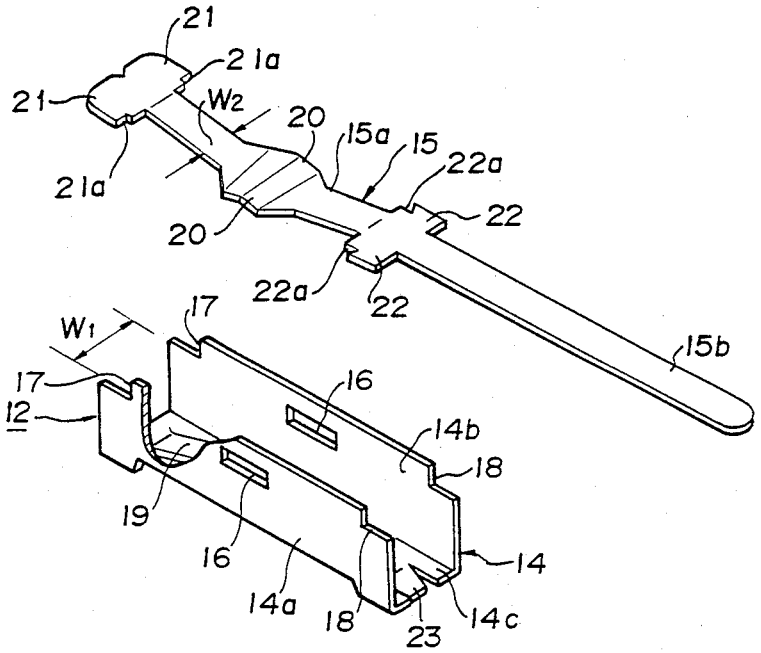
FIG. 3 is an exploded perspective view of the female connector piece according to the present invention.
Figure 4:
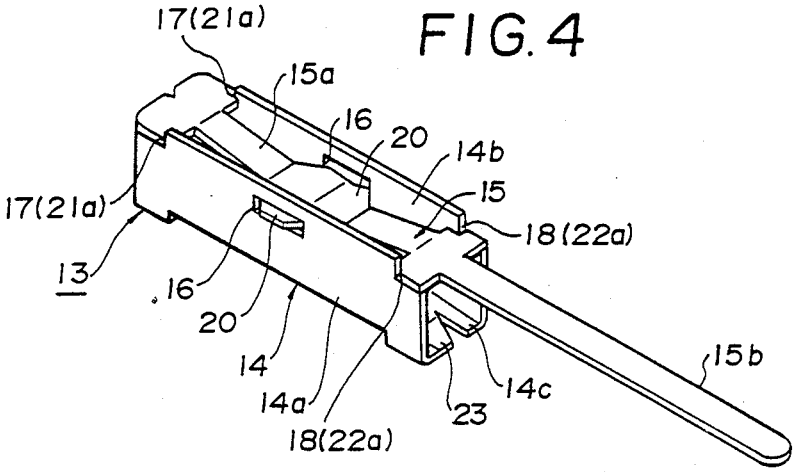
FIG. 4 is a perspective view of the connector piece shown in FIG. 3 in its assembled state.

Now, the specific structure of one of the connector pieces 12 is described in the following with reference to FIGS. 3 and 4.

Figure 5:
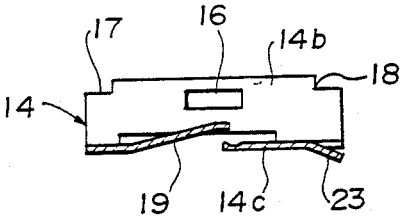
FIG. 5 is longitudinal sectional view of the main body of the connector piece given in FIGS. 3 and 4.
Figure 6:
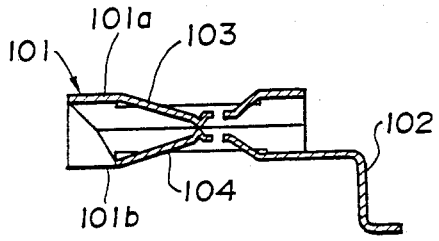
FIG. 6 PRIOR ART
FIGS. 6 and 7 are side sectional views of different conventional electric connector pieces for a female connector.
Figure 7:
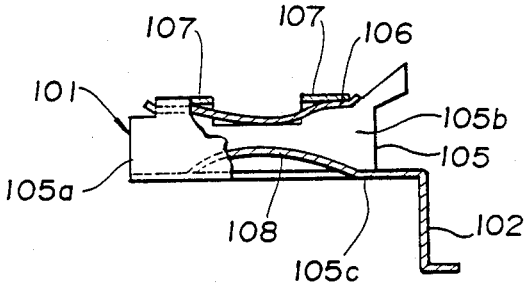
FIG. 7 PRIOR ART

This electric connector piece 12 consists of a connector piece main body 14, and an elongated contact piece 15 which is mounted to the main body 14, and these two parts jointly defines the elongated box-shape of this connector piece 12. The connector piece main body 14 is made of stainless steel, and has a C-shaped cross section by being provided with a pair of mutually opposing, elongated strips 14*a* and 14*b* which are joined together at their long sides by a connecting strip 14*c*. The lengthwise middle parts of the mutually opposing strips 14*a* and 14*b* are provided with rectangular fitting holes 16 and 16, respectively. The front ends of the mutually opposing strips 14*a* and 14*b* are provided with first steps 17 and 17, respectively, and the rear ends of the mutually opposing strips 14*a* and 14*b* are likewise provided with second steps 18 and 18, respectively. A spring tab 19 is bent obliquely from the front end of the connecting strip 14*c* towards the rear as shown in FIG. 5 so that the male electric connector piece M (FIG. 2) may be smoothly admitted into the rectangular cavity defined by the connector piece main body 14 and the contact piece 15 may be elastically urged against the contact piece 15 as the male electric connector piece M is inserted into the cavity.

The main part 15*a* of the contact piece 15 is provided with lateral projections 20 and 20 so as to correspond to the fitting holes 16 and 16, respectively. Further, the front end of the contact piece 15 is provided with similar lateral projections 21 and 21 which define first notches 21*a* and 21*a* adapted to engage with the corresponding first steps 17 and 17, respectively, of the connector piece main body 14 while the portions of the contact piece 15 situated to the rear of the projections 20 and 20 are provided with similar lateral projections 22 and 22 which likewise define second notches 22*a* and 22*a* adapted to engage with the second steps 18 and 18, respectively. The portion of the main part 15*a* of the contact piece 15 located between the first notches 21 and the second notches 22 is bent into a V-shape about a lateral line passing through the projections 20, while the rear end of the contact piece 15 is provided with an extension 15*b* constructed as a lead terminal piece and adapted to be bent into a prescribed configuration as illustrated in the upper part of FIG. 2. Alternatively, the extension 15*b* may be provided to the front end projections 21, instead of the rear end projections 22, as illustrated in the lower parts of FIGS. 1 and 2 and denoted with numeral 15*b'*, to avoid the interference with the extension of the contact piece arranged above it or to provide a better convenience of mounting the multiple female connector, to which this contact piece is applied, to a printed circuit board or the like.

Numeral 23 denotes an engagement tab which is bent from the rear end of the connecting strip 14*c* of the connector piece main body 14 for engagement with a depression or a hole 24 (FIG. 2) formed in the connector casing 11.

In the above described structure, the elongated, box-shaped electric connector piece 12 is formed by fitting the projections 20 and 20 of the contact piece 15 into the fitting holes 16 and 16 of the connector piece main body 14, engaging the first notches 21*a* and 21*a* of the contact piece 15 with the first steps 17 and 17 of the connector piece main body 14, and engaging the second notches 22*a* and 22*a* with the second steps 18 and 18, for mounting the contact piece 15 into the connector piece main body 14. When this electric connector piece 12 is inserted into the receiving hole 13 from the rear end of the connector casing 11, the engagement piece 23 is caught by the engagement depression or the engagement hole 24, and the electric connector piece 12 is securely held in the connector casing 11. The electric connector piece M of the male connector inserted from the insertion opening 11*a* comes into contact with the contact piece 15 under the elastic force of the spring piece 19.

Here, since the electric connector piece 12 consists of two pieces, or the C-shaped connector piece main body 14 and the elongated contact piece 15 assembled thereto, gold plating may be performed only to the contact piece 15 and the waste of material can be thereby avoided. Furthermore, since the contact piece 15 is held between the mutually opposing strips 14*a* and 14*b* of the connector piece main body 14, the width $w_2$ may be made substantially smaller than the width $w_1$ of the connector piece main body 14, and the manufacturing cost can be reduced by reducing the amount of gold plating.

Furthermore, since the the contact piece 15 is mounted to the connector piece main body 14 by way of the fitting portions 16 (20) of the two parts 14 and 15, and the first and the second engagement portions 17 (21*a* ) and 18 (22*a*), the assembly work is simplified as compared to the case which involves a crimping process. And, since the stress due to the inserting force of the electric connector piece M of the male connector can be absorbed by the fitting portions 16 (20) of the two parts, a favorable contact state can be maintained even in the case of multiple connectors even in the presence of dimensional errors in the corresponding male connector pins and/or the casing of the female connector.

What we claim is:

1. An electric female connector piece for receiving a pin-shaped male connector piece therein for achieving an electric connection therewith, comprising:

a connector piece main body having a C-shaped cross section by being provided with a pair of mutually opposing, elongated strips which are joined together at their long sides by a connecting strip;

a contact piece consisting of an elongated strip which is adapted to be disposed between said mutually opposing strips defining a cavity of a substantially rectangular cross section;

a fitting hole provided in a middle part of each of said mutually opposing strips for receiving a fitting projection provided in each lateral long edge of said contact piece;

a first engagement portion provided in each of said mutually opposing strips at its lengthwise end for engagement with a corresponding part of said contact piece;

a second engagement portion provided in each of said mutually opposing strips at its other lengthwise end for engagement with another corresponding part of said contact piece; and a spring tab bent from the said connecting strip for elastically urging said male connector piece against said contact piece.

2. An electric female connector piece as defined in claim 1, wherein at least one of said engagement portions comprises a step-shaped notch provided in each of said mutually opposing strips, and a lateral engagement projection provided in each lateral edge of said contact piece for defining a corresponding notch adapted to engage said step-shaped notch.

3. An electric female connector piece as defined in claim 2, wherein said contact piece is bent about a lateral line passing through said fitting projections with its convex surface facing said connecting strip.

4. As electric female connector as defined in claim 3, wherein said fitting holes substantially loosely receive said fitting projections.

* * * * *